US006126032A

United States Patent [19]

Herzog et al.

[11] Patent Number: 6,126,032

[45] Date of Patent: Oct. 3, 2000

[54] TWO-COMPONENT CONTAINER

[75] Inventors: Volker Herzog, Riedstadt; Joerg Mayer, Darmstadt-Eberstadt; Udo Kohn, Dieburg; Franz Steigerwald, Griesheim, all of Germany

[73] Assignee: Wella Aktiengesellschaft, Darmstadt, Germany

[21] Appl. No.: 09/423,681

[22] PCT Filed: Jan. 28, 1999

[86] PCT No.: PCT/EP99/00547

§ 371 Date: Nov. 10, 1999

§ 102(e) Date: Nov. 10, 1999

[87] PCT Pub. No.: WO99/48772

PCT Pub. Date: Sep. 30, 1999

[30] Foreign Application Priority Data

Mar. 23, 1998 [DE] Germany ..... 198 12 660

[51] Int. Cl.[7] ..... B65D 25/00

[52] U.S. Cl. ..... 220/501; 220/4.27; 206/221

[58] Field of Search ..... 220/501, 4.27; 206/221

[56] References Cited

U.S. PATENT DOCUMENTS

| | | | |
|---|---|---|---|
| 3,410,444 | 11/1968 | Morane | 206/221 X |
| 3,489,306 | 1/1970 | Bubb | 206/221 |
| 3,917,063 | 11/1975 | Chibret et al. | 206/221 |
| 4,203,517 | 5/1980 | Hildebrandt et al. | 206/221 |
| 4,483,439 | 11/1984 | Steigerwald et al. . | |
| 4,823,946 | 4/1989 | Stoeffler et al. . | |
| 4,865,189 | 9/1989 | Guerra et al. | 206/221 |
| 5,152,965 | 10/1992 | Fisk et al. | 206/221 X |

FOREIGN PATENT DOCUMENTS

| | | |
|---|---|---|
| 0260179 | 3/1988 | European Pat. Off. . |
| 2239390 | 2/1975 | France . |
| 37 22 371 A1 | 1/1989 | Germany . |
| 9314990 | 8/1993 | WIPO . |

*Primary Examiner*—Steven Pollard
*Attorney, Agent, or Firm*—Michael J. Striker

[57] ABSTRACT

In a two-component container (1), a connection between two chambers (6, 7) can be produced by the ejection of a stopper (5). By screwing the one container (3) into a thread (4) connected to another container (2), the stopper (5) is ejected out of its retaining element (14). An intermediary piece (19) is provided between the containers (2, 3) and rests with a support (20) on the upper rim (21) of the lower container (3). A sealing lip (30) between the connecting piece (10) and the intermediary piece (19) can be deflected elastically outward so that it produces a valve action in the event of an overpressure in the two-component container (1). The two-component container (1) is suited for separately storing peroxide and hair color.

6 Claims, 3 Drawing Sheets

TWO-COMPONENT CONTAINER

The invention relates to a two-component container with two containers that are separate from each other and communicate with each other after the ejection of a stopper, wherein each container has a chamber for containing one component, with a thread on a neck of the one container and another thread which is connected to the other container, wherein the threads engage in one another and the one container can be screwed in relation to the other container in such a way that the stopper is pushed out of its retaining element.

DE-OS 37 22 371 has disclosed a two-component container of this type which is suited for separately containing a hair color and an oxidation agent. After the ejection of the stopper, these two components are mixed with each other in order to obtain an active hair color. An annular, circumferential bead is provided under the outer thread of the lower container on its neck in order to seal the two-component container so the active hair color cannot flow out.

The known two-component container has the disadvantage that the sealing action of the bead depends highly on the manufacturing precision of the bead and the components adjoining it, which increases the cost of the two-component container. On the other hand, active hair color can get in between the threads. And finally, an overpressure possibly occurring in the two-component container can be relieved toward the outside more or less well only as a function of the manufacturing tolerance.

The object of the invention is to embody a two-component container of the type mentioned at the beginning so that a favorable seal is produced even with a larger manufacturing tolerance and that in so doing, an overpressure can be reduced in a reproducible manner.

The object is attained according to the characterizing part of claim 1. According to it, an intermediary piece is provided between the containers, which rests with a support against the upper rim of the container, an annular connecting piece is connected to the upper container, and a sealing lip is provided on the connecting piece and rests between the connecting piece and the intermediary piece in such a way that the sealing lip can be deflected elastically outward by the intermediary piece in order to thereby produce a valve action.

The invention has the advantage that the two-component container is favorably sealed even with a larger manufacturing tolerance since the sealing lip rests in an elastically deflectable manner between the connecting piece and the intermediary piece and compensates for a more imprecise distance by means of its elasticity. An overpressure is reduced in a reproducible manner by means of the valve action of the sealing lip. Moreover, the active hair color cannot get between the threads since this is prevented by the sealing lip. The sealing lip can be formed onto the connecting piece and rest against the intermediary piece or vice versa.

If both the sealing lip and the region of the intermediary piece which rests against the sealing lip are embodied as annular and circumferential (claim 2), then the seal fulfills its function in a circumferential manner.

The further sealing of the two-component container is produced by a seal in the vicinity of the upper rim of the lower container, by means of which the intermediary piece is sealed in relation to the rim (claim 3).

In order to simply and reliably activate the two-component container, an ejector can be provided, which has at least one opening and is connected to the upper container, wherein the stopper can be ejected downward out of a retaining element of the intermediary piece in which the stopper sits by means of the resistance of the ejector (claim 4). After an ejection, product can flow through the opening as a result of which the components mix with one another.

The two-component container can be used particularly well for dispensing active hair color if its crushable zone occupies at least 50 percent of the total axial height of the container (claim 6). The modest height of the dividing zone between the individual containers is particularly beneficial to the manual crushing.

A securing ring serves to prevent an unwanted activation of the two-component container and after the removal of this ring, one container can be screwed in relation to the other container (claim 5).

The invention will be explained in detail below in conjunction with an exemplary embodiment.

FIG. 1 is a vertical section through a two-component container with two containers which are sealed in relation to each other by means of a stopper, wherein the stopper can be removed from an intermediary piece by means of the resistance of an ejector, the intermediary piece rests with a support against the upper rim of the lower container, and on top, the intermediary piece rests against a sealing lip, which belongs to an annular connecting piece and has a valve function;

Figure 1:
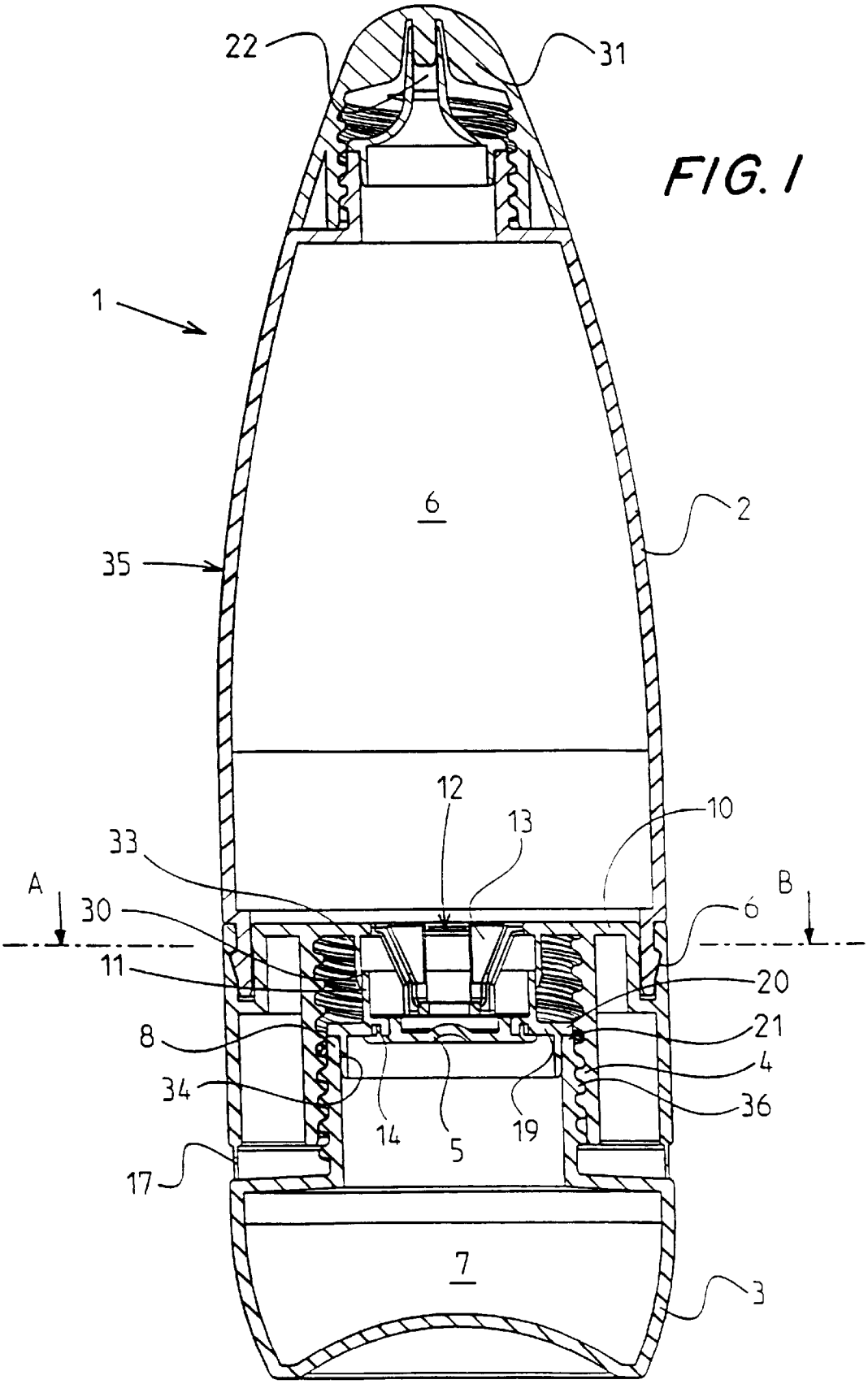

In a two-component container 1, two individual containers 2, 3 are connected to each other by means of threads. After an ejection of a stopper 5, the contents of the containers 2, 3 can be mixed with each other (FIG. 1). Each container 2, 3 has a chamber 6, 7. While one chamber 6 is provided for containing a peroxide as the one component, the other chamber 7 is provided for containing a hair color as the second component.

Figure 4:
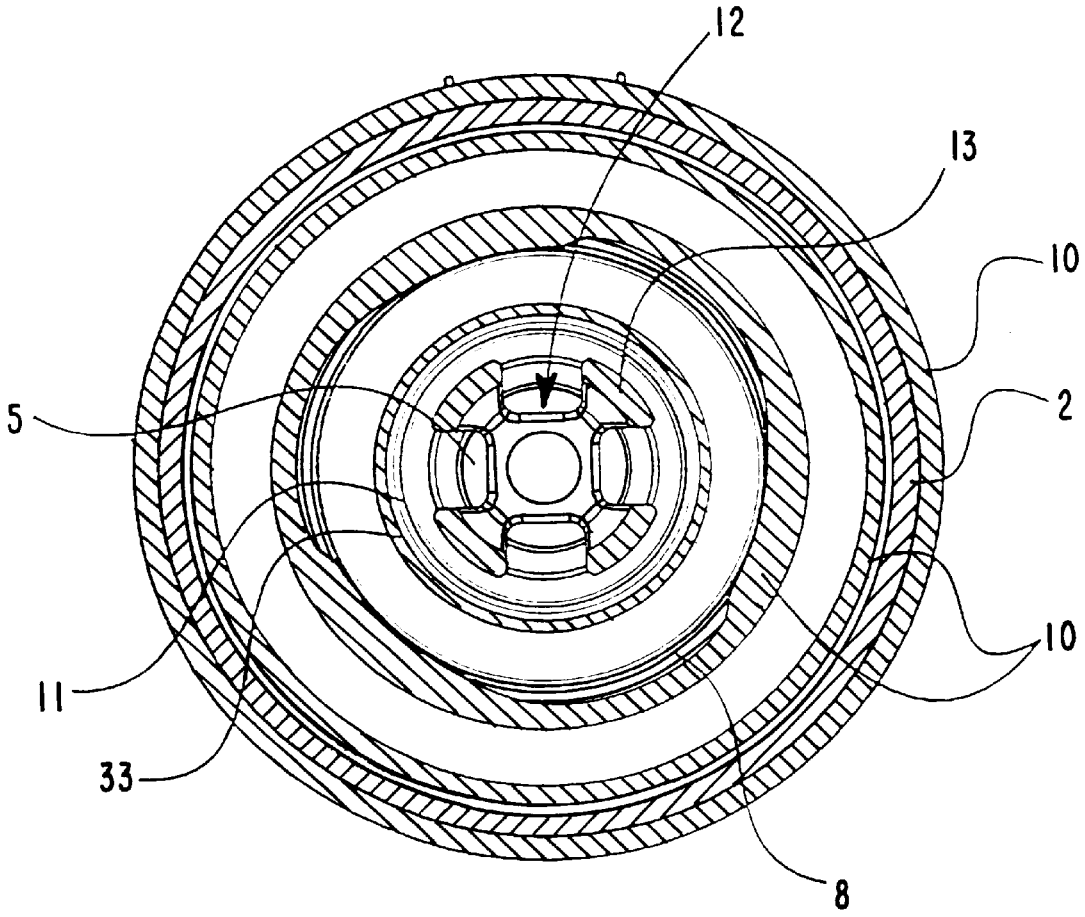
FIG. 4 shows a horizontal section along the line A–B of FIG. 1 in an enlarged depiction of the subject of FIG. 1.

At the neck 8 of the lower container 3, a thread 36 is provided which engages in the thread 4 of an annular connecting piece 10. The connecting piece 10 is connected to the container 2 by way of a snap connection 6. The lower container 3 can be screwed in relation to the upper container 2, wherein the stopper 5 is ejected from an intermediary piece 19 by an ejector 13 which has openings 12 (FIG. 4).

After the detachment of a securing ring 17, which can be grasped at a tab (not shown), the stopper 5 is ejected by means of the resistance of the ejector 13 and falls into the lower container 3. After the securing ring 17 is detached from the two-component container 1, the lower container 3 can be screwed further in relation to the upper container 2.

The intermediary piece 19 rests with a support 20 on the upper rim 21 of the lower container 3. The retaining element 14 has a press fit 25 in combination with a detent connection 24 (FIG. 3).

Figure 2:
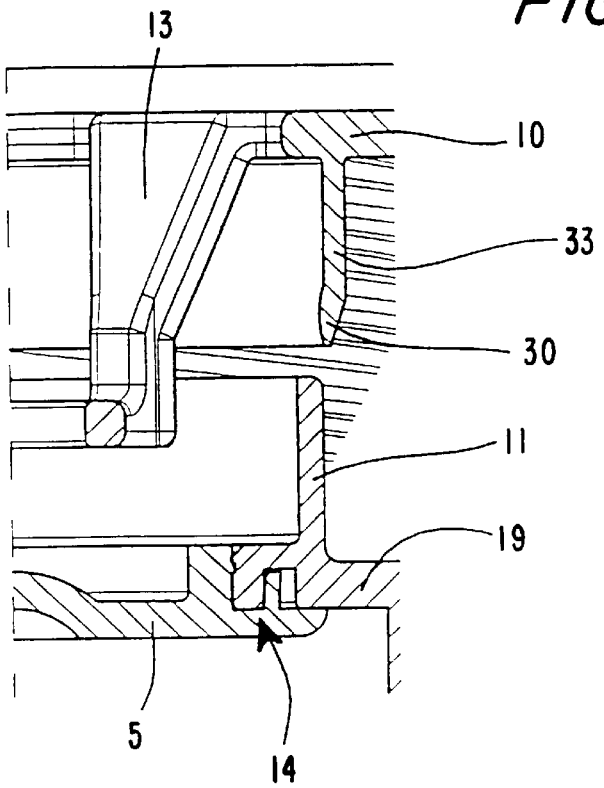
FIG. 2 shows a vertical section of an enlarged detail from FIG. 1.

A sealing lip 30 is provided (FIG. 2) on the connecting piece 10, and between the connecting piece 10 and the intermediary piece 19, rests against the intermediary piece 19 in such a way that the sealing lip 30 can be deflected elastically outward by the intermediary piece 19 in order to act as a valve in the event of an overpressure in the two-component container. The sealing lip 30, the region of the intermediary piece 10 adjoining the sealing lip 30, and a ring 11 of the intermediary piece 19 are embodied as annular and circumferential.

Figure 3:
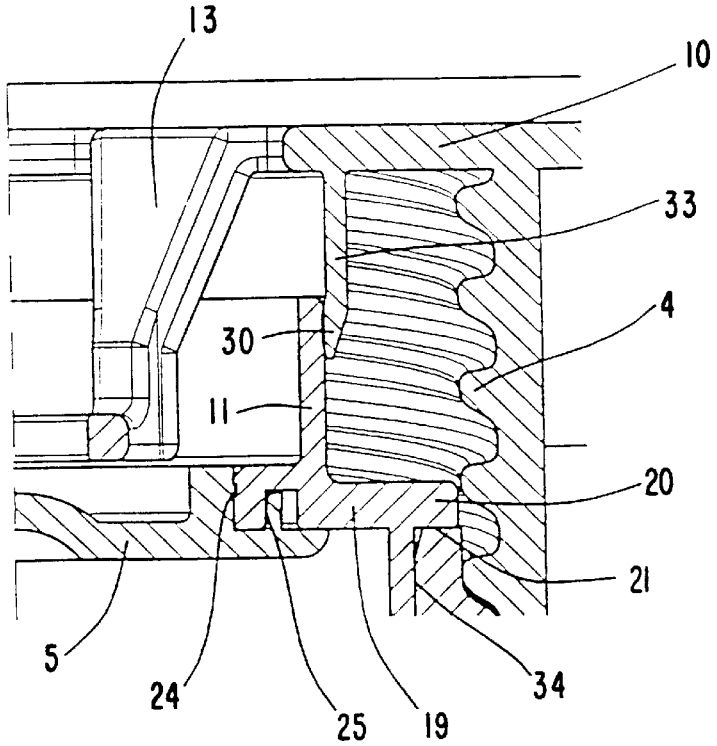
FIG. 3 shows a vertical section of another enlarged detail from FIG. 1.

The intermediary piece 19 is sealed in relation to the rim 21 of lower container 3 by means of a circumferential seal 34 FIG. 3).

The two-component container 1 is shaken after the mixing of the components and finally, after a cap 31 is unscrewed, the active hair color is applied through a dispensing opening 32 (FIG. 1). The crushable zone 35 of the two-component container 1 occupies more than 50 percent of the total axial height of the container, which results in an easy application.

What is claimed is:

1. A two-component container with two containers that are separate from each other and communicate with each other after the ejection of a stopper, wherein each container has a chamber for containing one component, with a thread on a neck of the one container and another thread which is connected to the other container, wherein the threads engage in one another and the one container can be screwed in relation to the other container in such a way that the stopper is ejected from its retaining element, characterized in that an intermediary piece (19) is provided between the containers (2, 3), which rests with a support (20) against the upper rim (21) of the lower container (3), that an annular connecting piece (10) is connected to the upper container (2), and that a sealing lip (30) is provided on the connecting piece (10) and rests between the connecting piece (10) and the intermediary piece (19) in such a way that the sealing lip (30) can be deflected elastically outward by the intermediary piece (19) or by the connecting piece (10) in order to thereby produce a valve action.

2. The two-component container according to claim 1, characterized in that both the lip (30) and the region (33) of the intermediary piece (10) or the connecting piece (10) resting against the sealing lip (30) are embodied as annular and circumferential.

3. The two-component container according to claim 1, characterized in that an ejector (13) is provided, which is connected to the upper container (2) and has at least one opening (12), and that by means of the resistance of the ejector (13), the stopper (5) can be ejected downward out of a retaining element (14) of the intermediary piece (19) in which it sits.

4. The two-component container according to claim 1, characterized in that the intermediary piece (19) is sealed in relation to the rim (21) by means of a seal (34) in the vicinity of the rim (21).

5. The two-component container according to claim 1, characterized in that a securing ring (17) is provided and after the detachment of this securing ring, one container (3) can be screwed in relation to the other container (2).

6. The two-component container according to claim 1, characterized in that the crushable zone (35) of the two-component container (1) occupies at least 50 percent of the total axial height of the container.

* * * * *